US006926067B1

(12) United States Patent
Hörneschemeyer et al.

(10) Patent No.: US 6,926,067 B1
(45) Date of Patent: Aug. 9, 2005

(54) LIQUID-COOLED CASTING DIE

(75) Inventors: Wolfgang Hörneschemeyer, Osnabrück (DE); Gerhard Hugenschütt, Belm (DE); Dirk Rode, Osnabrück (DE); Hector Villanueva, deceased, late of Osnabrück (DE); by Elisabeth Breulmann de Villanueva, legal representative, Osnabrück (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/372,636

(22) Filed: Aug. 11, 1999

Related U.S. Application Data

(63) Continuation of application No. 09/237,803, filed on Jan. 27, 1999, now abandoned.

(30) Foreign Application Priority Data

Jan. 27, 1998 (DE) ..... 198 02 809

(51) Int. Cl.[7] ..... B22D 11/04
(52) U.S. Cl. ..... 164/418; 164/443
(58) Field of Search ..... 164/443, 485, 164/418, 348, 459

(56) References Cited

U.S. PATENT DOCUMENTS

| | | | | | |
|---|---|---|---|---|---|
| 3,595,302 | A | * | 7/1971 | Mallener | 164/443 |
| 4,658,884 | A | * | 4/1987 | Euler et al. | 164/443 |
| 5,095,970 | A | * | 3/1992 | Klein et al. | 164/485 |
| 5,117,895 | A | * | 6/1992 | Hargassner et al. | 164/443 |
| 5,201,361 | A | * | 4/1993 | Grove et al. | 164/459 |
| 5,207,266 | A | * | 5/1993 | Nakashima et al. | 164/348 |
| 5,526,869 | A | * | 6/1996 | Sears, Jr. et al. | 164/443 |
| 5,611,390 | A | * | 3/1997 | Benedetti et al. | 164/485 |
| 5,797,444 | A | * | 8/1998 | Villanueva et al. | 164/418 |
| 5,887,644 | A | * | 3/1999 | Akiyoshi et al. | 164/428 |
| 5,899,259 | A | * | 5/1999 | Rode et al. | 164/418 |
| 5,927,378 | A | * | 7/1999 | Grove et al. | 164/485 |
| 6,145,579 | A | * | 11/2000 | Stagge et al. | 164/418 |
| 2003/0230394 | A1 | | 12/2003 | Hemschemeier et al. | 164/418 |

FOREIGN PATENT DOCUMENTS

| | | | | |
|---|---|---|---|---|
| DE | 41 27 333 | * | 2/1993 | B22D 11/04 |
| DE | WO-97/43063 | A1 * | 11/1997 | B22D 11/04 |
| DE | 197 16 450 | * | 5/1998 | B22D 11/04 |
| DE | EP 0 931 609 | * | 7/1999 | B22D 11/04 |
| EP | 0730923 | | 9/1996 | |

(Continued)

OTHER PUBLICATIONS

Partial European Search Report (3 pages) listing cited references.

*Primary Examiner*—Kevin P. Kerns
(74) *Attorney, Agent, or Firm*—Kenyon & Kenyon

(57) ABSTRACT

A liquid-cooled casting die for the continuous casting of thin steel slabs has a molding casting die body made of a material of high heat conductivity, such as copper or a copper alloy. Preferably the casting die body is made, in each case, of two broad-side walls, situated facing each other, and narrow-side walls limiting the width of the billet, the broadside walls forming a funnel-shaped pouring-in area. In order avoid the formation of cracks in the thermally and mechanically more stressed areas of the copper plate, cooling zones are arranged particularly in the bath surface area having higher surface-related heat flow.

49 Claims, 2 Drawing Sheets

FOREIGN PATENT DOCUMENTS

| | | | | |
|---|---|---|---|---|
| GB | 2156252 | | 10/1985 | |
| GB | 2 177 331 | * | 1/1987 | ..... B22D 11/04 |
| GB | 2212084 | | 7/1989 | |
| JP | 59-133940 | * | 8/1984 | ..... B22D 11/04 |
| SU | 1 366 282 | * | 1/1988 | ..... B22D 11/04 |
| SU | 1366 282 A | | 1/1988 | |
| WO | 97/43063 | * | 11/1997 | ..... B22D 11/04 |
| WO | WO 9841342 | | 9/1998 | |

* cited by examiner

LIQUID-COOLED CASTING DIE

This application is a CON of Ser. No. 09/237,803 filed Jan. 27, 1999 now abandoned.

BACKGROUND OF THE INVENTION

1. Field of the Invention

The invention relates to a liquid-cooled casting die for a continuous casting installation having a form-giving casting die body made of a material of high thermal conductivity, such as copper or a copper alloy.

2. Description of Related Art

Casting dies are designed to remove heat from the molten metal and to make it possible for the billet to solidify all the way through, beyond the casting shell that forms at the outset.

Various casting die geometries are in use, depending on the application, such as casting die tubes in round, rectangular, or complex shapes. Casting die plates are used for square/rectangular cogs [cogged ingots] or for slabs having greater height-width ratios. In addition, there are special geometries, such as preliminary sections for double-T supports and thin-slab casting dies having funnel expansion in the upper plate area for receiving the pouring nozzle. It is characteristic of all these casting dies that their goal is a homogeneous cooling of the surfaces. The corner areas represent special cases since in plate-type casting dies, by virtue of the design, there are, for example, abutting edges having disrupted cooling. In addition, there are some areas having larger material volumes for the reverse-side mounting elements, the areas, with a view to identical cooling, being adjusted at the start using specially configured groove-shaped coolant channels.

It is also known to provide improved cooling to casting dies subject to particularly high thermal stresses, in order to avoid premature damage to the casting die. This means in the case of thin-slab casting dies, that the thermal resistance of the casting die wall should not be too great, for which reason thinner walls are chosen. Moreover, given the higher pouring rates that are targeted, particular demands are placed on cooling-water quality and flow rate.

All of the cited measures have the same goal, to provide the pouring side of the casting die body with the best possible, homogeneous cooling. Potential areas of disruption due to the type of construction, such as at reverse-side cooling surfaces, are eliminated when the occasion arises, in order to obtain once again a uniform cooling.

The local conditions of stress in the use of funnel casting die plates are dependent on the operating conditions. On the pouring side, they are basically determined by the kind of steel pouring temperature, the speed, the lubrication/cooling conditions of the pouring powder, the geometry of the pouring nozzle, and the corresponding flow of the molten mass. On the other side, the water side, the casting die temperatures are determined by the quality, quantity, and flow rate of the cooling water. These variables are partly determined already by the casting die design, such as in the geometry of the coolant channels.

Using the destructive test of numerous casting die plates in use in various steel mills, however, the actual stressing and also the damage resulting thereby of the casting die material can be clearly determined. On the basis of these tests, a varying weakening of the surface and of the area near the surface extending across the width of the meniscus can be established.

Thus, in the critical area, the hardness falls from 100% of the output value to approximately 60%, whereas at the same level near the critical area, only a fall of approximately 70% of the output hardness is measured; in this context, the edge area of the casting die plates does not come into consideration. Similar results are yielded by measurements of the wall thickness after use of the casting die plates; identical material weaknesses in the critical area of the bath surface extending across roughly one-third of the greater depths in comparison to the uncritical areas.

Thin-ingot casting dies are stressed to different extents as a result of the varying influences on the broad side walls. Among these influences are essentially:

- a high flow rate of the steel molten mass; turbulence of the molten mass particularly stresses the transitional areas of the funnel into the plane-parallel sides of the casting cross-section.
- a higher mechanical stressing of the wall of the copper plate bent in the funnel discharge as a result of thermal expansion. The resulting stresses are particularly high on the pouring side.

This leads to a particularly pronounced softening of the casting die material in this transitional area of the funnel. As a result of the locally relatively higher temperatures and the higher material loads related to the respective resistance to heat of a material-volume element, cracks can appear prematurely in this surface area. These cracks are more likely to occur due to a diffusion process, marked here as temperature dependent, of Zn-atoms from the steel into the Cu-matrix, because the Cu—Zn phases which arise form a hard and brittle surface layer which makes possible higher rate of crack formation.

SUMMARY OF THE INVENTION

It is an object of the invention to create a casting die body in which the heat flow is raised in the bath surface area, and the danger of the formation of cracks in the thermally and mechanically more stressed areas can be avoided.

These and other objects of the invention are achieved by a liquid-cooled casting die for a continuous casting installation, having a form-giving casting die body made of a material of high heat conductivity such as copper or a copper alloy, wherein the casting die body, on the cooling-surface side in the more thermally and mechanically stressed areas, has a cooling zone having a greater rate of heat flow relative to the surface.

BRIEF DESCRIPTION OF THE DRAWINGS

The invention will be explained in greater detail in the following detailed description of the preferred embodiment in conjunction with the accompanying drawings, in which.

DETAILED DESCRIPTION OF THE INVENTION

The casting die body has, running parallel to the pouring direction, a groove-shaped coolant channel or cooling bore holes, which in the thermally and mechanically stressed areas are configured narrower. The cooling bores are arranged between the coolant channels.

Figure 2:
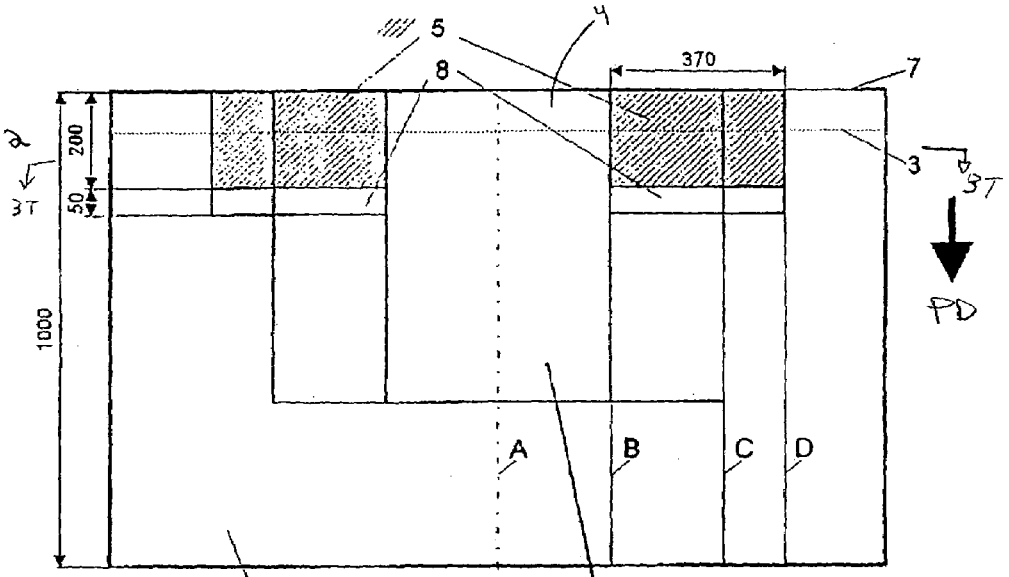
FIG. 2 is a side view of a casting die plate.
Figure 3:
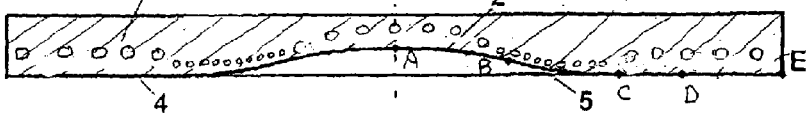
FIG. 3 is a transverse cross sectional view taken along line 3T in FIG. 2.

The crux of the invention is the feature of putting into place a significantly stronger cooling of the casting die body in the supercritically stressed areas on both sides of the funnel. According to the invention, it is proposed to increase the cooling capacity in these critical areas preferably 10 to 20% in relation to the horizontal adjoining areas. Coolant channels 6 (FIGS. 4 and 5), for example, can be advantageously made narrower here (FIG. 4), so that the cooled surface is made larger. Alternatively, the coolant channels 6 can be brought closer to the surface locally (FIG. 5); in this case, the system operates, in an unusual fashion, with varying—effectively active—cooling wall thicknesses above the co to cooling bore holes 14 (FIG. 3). In addition, broad-side plates, configured having groove-shaped coolant channels 6, in the critical areas of the funnel transition can be provided with additional cooling bore holes 14; in a surprising manner, in spite of the small wall thickness, the resistance to cracks of the casting die material is increased also here and with it the overall durability of the casting die plate.

Moreover, on the basis of varying cooling intensities on the reverse side, a significantly smoother temperature profile is achieved on the pouring side of the plate surface. This effect makes possible a smaller temperature interval for a sensible, narrower operating temperature range of the pouring powder. Thus the adjustment of the pouring powder to a colder or hotter temperature range can be avoided.

Below, the invention is explained in greater detail on the basis of the exemplary embodiments presented in the drawings.

The funnel casting die plate 1 has running parallel to the pouring direction PD, cooling bore holes 14 and/or groove shaped coolant channels 6, which in thermally and mechanically stressed areas of the die plate 1, detailed below, are (i) configured narrower in diameter, i.e., have a lower effective cross sectional area, (ii) run closer to the pouring side 4, and (iii) are spaced closer to each other. It is noted that the die plate 1 may include any combination of these cooling features and may also include only a single one of these features, i.e., may only have, for example, cooling bore holes 14 that are configured narrower in the thermally and mechanically stressed areas but not running closer to the pouring side and spaced closer to each other in the thermally and mechanically stressed areas, etc.

Figure 1:
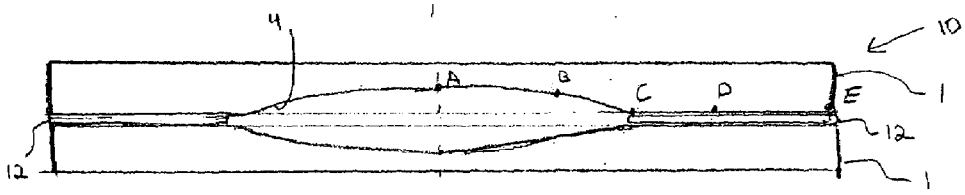
FIG. 1 is top view of a casting die body in accordance with the invention.
Figure 4:
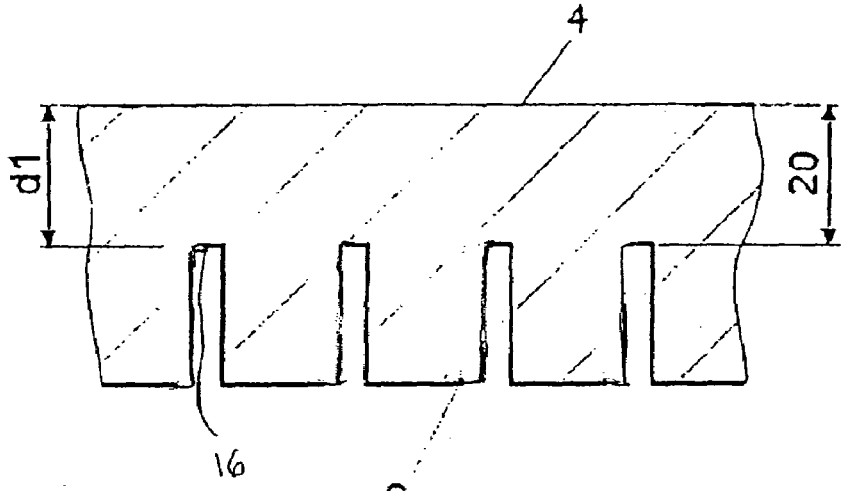
FIG. 4 is a detailed view of a portion of the side plate (shown without bore holes)
Figure 5:
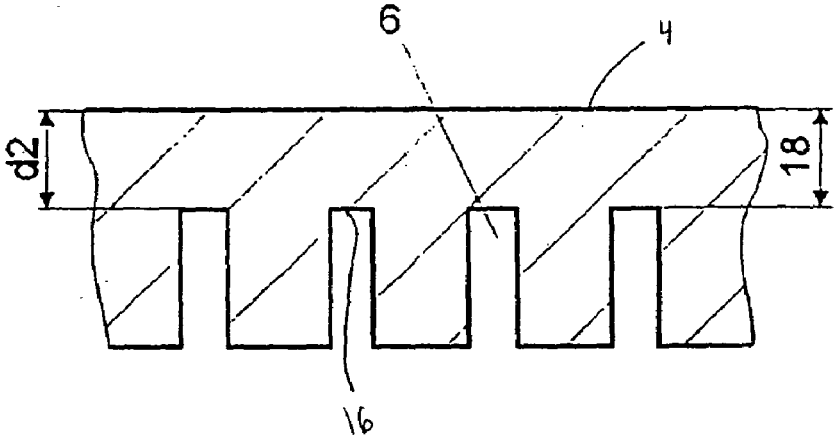
FIG. 5 is a detailed view of another portion of the side plate (shown without bore holes).

Funnel casting die plate 1, represented in FIG. 1, in the horizontal dimension (vertical line C) of funnel 2 on a pouring side 4, has the highest thermal stressing. A direct consequence is a maximum surface-related heat flow of 4.7 to 5.2 and $MW/m^2$ lying directly beneath bath surface 3 at C in the pouring direction PD. Present on pouring side 4 of casting die plate 1 are maximum temperatures of approximately 400° C., calculated by computer. Actively effective wall thickness d of casting die plate 1 of copper is now reduced in critical area 5 between the lines B, C, and D, to the upper 200 mm of the casting die plate from $d_1$=20 mm to $d_2$=18 mm (FIGS. 4 and 5).

Thus a maximum surface temperature this reduced by 28° C. is achieved; this preferred cooling is maintained given appropriate reworking of casting die plate 1. Although the wall thickness d2 in critically stressed area 5 is 2 mm smaller, the result, surprisingly, is still a generally greater service lifetime of casting die plate 1, including reworking. Area 5, which is more intensively cooled due to cooling grooves 6 that are placed deeper (wall thickness between pouring surface 4 and a cooling surface 16, 18 mm instead of 20 mm) and cooling bore holes 14 that are spaced closer and run closer to the pouring surface, extends, in the present case, over the following surfaces (see FIGS. 3 to 5): the horizontal length from turning point B of funnel 2 more than 370 mm to end point D. The more intensive cooling surface extends from plate upper edge 7 up to 200 mm in the pouring direction PD; adjoining is a transitional zone 8 of 50 mm, in which the depth d of cooling grooves 6 is adjusted. The cooling bore holes 14 may be arranged between the cooling grooves 6.

What is claimed is:

1. A liquid-cooled casting die for continuous billet casting comprising:

a form-giving casting die body having at least one broad side wall with a pouring-surface for receiving molten metal in a pouring direction, a cooling-surface in contact with a cooling bath, the pouring-surface and the cooling-surface defining a thickness, and cooling bore holes running parallel to the pouring direction and at least one of (i) running closer to the pouring surface, (ii) being configured narrower in diameter, and (iii) being spaced closer to each other in at least one portion of the die body.

2. The casting die body as recited in claim 1, wherein the form-giving casting die body is made of copper or a copper alloy.

3. The casting die body as recited in claim 1, further comprising a die cavity (2) defined by two broad-side walls situated opposite each other and two narrow-side walls, the narrow-side walls forming a cross-section of the die cavity.

4. The casting die body as recited in claim 3, wherein the cross-section of the die cavity at a first end is greater than at a second end.

5. The casting die body as recited in claim 3, wherein the broad-side walls further define a funnel running from the first end to the second end and the at least one portion of the die body including sides of the funnel.

6. The casting die body as recited in claim 5, wherein the at least one portion extends to cover an area that is at least 20% more than the sides of the funnel.

7. The casting die body as recited in claim 5, wherein the at least one portion extends to cover an area that is 30–60% more than the sides of the funnel.

8. The casting die body as recited in claim 1, wherein the cooling surface comprises a plurality of cooling channels.

9. The casting die body as recited in claim 8, wherein the cooling channels run deeper in the at least one portion of the die body such that the thickness separating the pouring-surface from the cooling-surface is reduced in said at least one portion of the die body.

10. The casting die body as recited in claim 9, wherein the thickness is reduced by 1 to 6 mm.

11. The casting die as recited in claim 8, wherein the casting die includes a die cavity defined by two broad-side walls defining a funnel and the cooling channels are narrower on both sides of the funnel.

12. The casting die as recited in claim 8, wherein the cooling bore holes are arranged between the cooling channels.

13. A liquid-cooled casting die for continuous billet casting comprising:

a form-giving casting die body having at least one broad side wall with a pouring-surface for receiving molten metal in a pouring direction, a cooling-surface in contact with a cooling bath, the pouring-surface and the cooling-surface defining a thickness, and cooling bore holes running parallel to the pouring direction and being spaced at least 20% closer to each other in at least one portion of the die body, wherein the broad-side walls define a funnel having sides, the at least one portion of the die body including the sides.

14. A liquid-cooled casting die for continuous billet casting comprising:

a form-giving casting die body having at least one broad side wall with a pouring-surface for receiving molten metal in a pouring direction, a cooling-surface in contact with a cooling bath, the pouring-surface and the cooling-surface defining a thickness, and cooling bore holes running parallel to the pouring direction and running closer to the pouring surface in at least one portion of the die body.

15. The casting die body as recited in claim 14, wherein the form-giving casting die body is made of copper or a copper alloy.

16. The casting die body as recited in claim 14, further comprising a die cavity defined by two broad-side walls situated opposite each other and two narrow-side walls, the narrow-side walls forming a cross-section of the die cavity.

17. The casting die body as recited in claim 16, wherein the cross-section of the die cavity at a first end is greater than at a second end.

18. The casting die body as recited in claim 16, wherein the broad-side walls further define a funnel running from the first end to the second end and the at least one portion of the die body including sides of the funnel.

19. The casting die body as recited in claim 18, wherein the at least one portion extends to cover an area that is at least 20% more than the sides of the funnel.

20. The casting die body as recited in claim 18, wherein the at least one portion extends to cover an area that is 30–60% more than the sides of the funnel.

21. The casting die body as recited in claim 14, wherein the cooling surface comprises a plurality of cooling channels.

22. The casting die body as recited in claim 21, wherein the cooling channels run deeper in the at least one portion of the die body such that the thickness separating the pouring-surface from the cooling-surface is reduced in said at least one portion of the die body.

23. The casting die body as recited in claim 22, wherein the thickness is reduced by 1 to 6 mm.

24. The casting die as recited in claim 21, wherein the casting die includes a die cavity defined by two broad-side walls defining a funnel and the cooling channels are narrower on both sides of the funnel.

25. The casting die as recited in claim 21, wherein the cooling bore holes are arranged between the cooling channels.

26. A liquid-cooled casting die for continuous billet casting comprising:

a form-giving casting die body having at least one broad side wall with a pouring-surface for receiving molten metal in a pouring direction, a cooling-surface in contact with a cooling bath, the pouring-surface and the cooling-surface defining a thickness, and cooling bore holes running parallel to the pouring direction and being configured narrower in diameter in at least one portion of the die body.

27. The casting die body as recited in claim 26, wherein the form-giving casting die body is made of copper or a copper alloy.

28. The casting die body as recited in claim 26, further comprising a die cavity defined by two broad-side walls situated opposite each other and two narrow-side walls, the narrow-side walls forming a cross-section of the die cavity.

29. The casting die body as recited in claim 28, wherein the cross-section of the die cavity at a first end is greater than at a second end.

30. The casting die body as recited in claim 28, wherein the broad-side walls further define a funnel running from the first end to the second end and the at least one portion of the die body including sides of the funnel.

31. The casting die body as recited in claim 30, wherein the at least one portion extends to cover an area that is at least 20% more than the sides of the funnel.

32. The casting die body as recited in claim 30, wherein the at least one portion extends to cover an area that is 30–60% more than the sides of the funnel.

33. The casting die body as recited in claim 26, wherein the cooling surface comprises a plurality of cooling channels.

34. The casting die body as recited in claim 33, wherein the cooling channels run deeper in the at least one portion of the die body such that the thickness separating the pouring-surface from the cooling-surface is reduced in said at least one portion of the die body.

35. The casting die body as recited in claim 34, wherein the thickness is reduced by 1 to 6 mm.

36. The casting die as recited in claim 33, wherein the casting die includes a die cavity defined by two broad-side walls defining a funnel and the cooling channels are narrower on both sides of the funnel.

37. The casting die as recited in claim 33, wherein the cooling bore holes are arranged between the cooling channels.

38. A liquid-cooled casting die for continuous billet casting comprising:

a form-giving casting die body having at least one broad side wall with a pouring-surface for receiving molten metal in a pouring direction, a cooling-surface in contact with a cooling bath, the pouring-surface and the cooling-surface defining a thickness, and cooling bore holes running parallel to the pouring direction and being spaced closer to each other in at least one portion of the die body.

39. The casting die body as recited in claim 38, wherein the form-giving casting die body is made of copper or a copper alloy.

40. The casting die body as recited in claim 38, further comprising a die cavity defined by two broad-side walls situated opposite each other and two narrow-side walls, the narrow-side walls forming a cross-section of the die cavity.

41. The casting die body as recited in claim 40, wherein the cross-section of the die cavity at a first end is greater than at a second end.

42. The casting die body as recited in claim 40, wherein the broad-side walls further define a funnel running from the first end to the second end and the at least one portion of the die body including sides of the funnel.

43. The casting die body as recited in claim 42, wherein the at least one portion extends to cover an area that is at least 20% more than the sides of the funnel.

44. The casting die body as recited in claim 42, wherein the at least one portion extends to cover an area that is 30–60% more than the sides of the funnel.

45. The casting die body as recited in claim 38, wherein the cooling surface comprises a plurality of cooling channels.

46. The casting die body as recited in claim 45, wherein the cooling channels run deeper in the at least one portion of the die body such that the thickness separating the pouring-surface from the cooling-surface is reduced in said at least one portion of the die body.

47. The casting die body as recited in claim 46, wherein the thickness is reduced by 1 to 6 mm.

48. The casting die as recited in claim 45, wherein the casting die includes a die cavity defined by two broad-side walls defining a funnel and the cooling channels are narrower on both sides of the funnel.

49. The casting die as recited in claim 45, wherein the cooling bore holes are arranged between the cooling channels.

* * * * *